US005628298A

United States Patent [19]

Murata

[11] Patent Number: 5,628,298

[45] Date of Patent: May 13, 1997

[54] WATERPROOF SPARK PLUG HOLE CAP OF INTERNAL COMBUSTION ENGINE

[75] Inventor: Shigemi Murata, Tokyo, Japan

[73] Assignee: Mitsubishi Denki Kabushiki Kaisha, Tokyo, Japan

[21] Appl. No.: 651,877

[22] Filed: May 21, 1996

[30] Foreign Application Priority Data

Oct. 13, 1995 [JP] Japan ..... 7-291779

[51] Int. Cl.[6] ..... H01T 13/06

[52] U.S. Cl. ..... 123/635; 123/143 C

[58] Field of Search ..... 123/143 C, 169 PA, 123/169 PH, 635; 439/125, 127

[56] References Cited

U.S. PATENT DOCUMENTS 5,462,023 10/1995 Furuya ..... 123/143 C

FOREIGN PATENT DOCUMENTS 5-21175 3/1993 Japan .

*Primary Examiner*—Tony M. Argenbright

*Attorney, Agent, or Firm*—Sughrue, Mion, Zinn, Macpeak & Seas

[57] ABSTRACT

In a plug hole cap of an ignition apparatus for an internal combustion engine, the plug hole cap has a high water resistant characteristic with respect to the plug hole, and is manufactured in low cost. The ignition apparatus includes a cylinder head cover for fixing an ignition coil, an ignition plug stored in a plug hole formed in the cylinder head cover, a plug hole cap for closing an upper portion of the plug hole and an air bleeding hole penetrating the plug hole cap, for communicating the plug hole with the atmosphere. In particular, a water resistant wall covers at least an outside of a peripheral portion of an air bleeding hole outlet of the plug hole cap.

8 Claims, 5 Drawing Sheets

WATERPROOF SPARK PLUG HOLE CAP OF INTERNAL COMBUSTION ENGINE

BACKGROUND OF THE INVENTION

The present invention generally relates to an ignition apparatus for an internal combustion engine. More specifically, the present invention is directed to a waterproof spark plug hole cap of an ignition apparatus.

In FIG. 1, there is schematically shown a sectional view of the conventional ignition apparatus for the internal combustion engine disclosed in Japanese Laid-open Utility Model Application No. 5-21175. In this drawing, reference numeral 1 shows a decorative cover, reference numeral 2 indicates an ignition coil, reference numeral 2*a* represents a lower surface of an ignition coil case, and reference numeral 3 denotes a cylinder head cover of an internal combustion engine for fixing the ignition coil 2. Also, reference numeral 3*a* is an upper surface of the cylinder head cover 3, reference numeral 3*b* shows a plug hole inlet portion having a shape of a projected portion having a shape of a projected ring, and formed on an upper edge portion of the cylinder head cover 3, reference numeral 4 shows an ignition (spark) plug positioned on the cylinder of the internal combustion engine, reference numeral 4*a* indicates a plug gap projected into an inside of a combustion room of the internal combustion engine, and reference numeral 5 represents a plug hole of the cylinder head cover 5 for storing the ignition plug 4 at a bottom thereof. Reference numeral 6 is a plug hole cap sealed at an upper portion of the plug hole inlet portion 3*b*, reference numeral 6*a* indicates a lid-shaped portion for covering the plug hole inlet portion 3*b*, and is closely fitted to the plug hole inlet portion 3*b* by way of elastic recovery force of rubber, reference numeral 6*b* shows a second water resistant (waterproof) seal portion formed at a peripheral portion of the plug hole cap 6 with being projected from the plug hole cap 6, and having a function used to center the plug hole 5 and the plug hole cap 6. Furthermore, reference numeral 6*c* shows a cylindrical-shaped portion projected upwardly from the lid-shaped portion 6*a*, and reference numeral 6*d* is an air bleeding hole, or a purge hole penetrating from the center of the cylindrical-shaped portion 6*c* via the plug hole cap 6 to the plug hole 5, and also reference numeral 6*e* is an outlet of the air bleeding hole 6*d*.

A description will now be made of operations. When water happens to enter into the plug hole 5, water components would penetrate from the surfaces located along the connection boundary. As a result, the high voltage withstanding performance cannot be maintained, the high voltage leaks into the inner wall 3*c* of the plug hole 5, and then discharge failure occurs in the plug gap 4*a*, so that the internal combustion engine cannot be brought into the normal operation condition.

Therefore, it is required to avoid that water or water components enter from the upper surface 3*a* of the cylinder head cover into the lid-shaped portion 6*a* of the plug hole cap 6 and the second water resistant seal portion 6*b*. It should be noted that in response to the drive and stop operations of the internal combustion engine, the temperature in the plug hole 5 is greatly changed, and then air inside the plug hole 5 is expanded and contracted. When this contraction level would become large, water would enter from the seal portion into the plug hole 5. Accordingly, to cause air to flow in/out from the plug hole 5, the air bleeding hole outlet 6*e* is formed at a position where no water may enter.

As conditions under which the plug hole cap 6 is wetted by water, or water enters into the plug hole cap 6, there are such cases that the plug hole cap 6 is wetted by scattered water mixed into the engine room while the vehicle is driven in the rain, and reserved water flowing over the upper surface of the cylinder head enters from the seal portion. When there is a small amount of the scattered water, this scattered water is shielded by the lower surface 2*a* of the ignition coil case located just above the plug hole cap, so that the scattered water does not enter from the air bleeding hole outlet 6*e*. With respect to the reserved water, since the air bleeding hole outlet 6*e* is located higher the upper surface 3*a* of the cylinder head cover, the water reserved at the upper surface 3*a* of the cylinder head cover does not flow therein. However, when there are large amounts of scattered water, this scattered water cannot be shielded. Also, when the water level of the reserved water at the upper surface of the cylinder head cover exceeds the air bleeding hole outlet 6*e*, this reserved water will enter. Thus, to limit the wetted amount of water, either the decorative cover 1 is mounted, or the water exhausting path is formed in the cylinder cover 3 and further the upper surface 3*a* is inclined, so that an increase of the water level is prevented.

Since the conventional plug hole cap portion of the internal combustion engine is constructed of the above-described structure, as to the scattered water, a large amount of which directly flows from the upper portion of the ignition coil into this plug cap portion, the air bleeding hole outlet is directly wetted by the scattered water and thus there is no way to avoid that the scattered water enters therein. Also, as to the reserved water caused by entering a large amount of water, the position of the ignition coil must be set to the higher position in order to set the position of the air bleeding hole outlet. However, there is such a problem to employ the above-described structural modification in very narrow engine rooms developed in recent years.

Moreover, there is a current trend to discontinue the use of decorative cover in recent automobiles in order to reduce the manufacturing cost. On the other hand, there is another problem that since, for instance, a cooling air intake inlet for an inter cooler is formed in a bonnet of a vehicle with a turbocharger, rainwater would directly enter into engine room.

SUMMARY OF THE INVENTION

The present invention has been made to solve the above-described problems of the conventional plug hole cap portion, and therefore, has an object to provide a plug hole cap of an internal combustion engine, by which neither water, nor rainwater enters into a plug hole even which an ignition coil is directly wetted by a large amount of the water. Another object of the present invention is to manufacture such a plug hole cap with high reliability in low cost.

According to the invention, an ignition apparatus of an internal combustion engine comprises a water resistant wall for covering at least an outside of a peripheral portion of an air bleeding hole outlet of the plug hole cap.

Further, an ignition apparatus of an internal combustion engine comprises an upper surface of the water resistant wall made in contact with a lower surface of the ignition coil, so that the shielding performance thereof can be improved.

Furthermore, an ignition apparatus of an internal combustion engine comprises an air bleeding/water exhausting space formed in an inside of the water resistant wall, so that both of air and water can smoothly flow therethrough.

Still further, an ignition apparatus of an internal combustion engine comprises the plug hole cap subdivided into an upper plug hole cap and a lower plug hole cap; and a tower having an air bleeding hole communicated with the air bleeding hole formed in the lower plug hole cap, which is provided with the upper plug hole cap.

Moreover, an ignition apparatus of an internal combustion engine comprises a ring-shaped air flow path formed in an upper surface of the lower plug hole cap; a cylinder-shaped portion formed in the upper surface of the lower plug hole cap in such a manner that the cylinder-shaped portion is projected from a bottom portion of the ring-shaped air flow path; and an air bleeding hole outlet formed in an upper surface of the cylinder-shaped portion.

Still further, according to the present invention, a terminal portion of the air bleeding hole formed in the tower is directed to the ignition coil.

BRIEF DESCRIPTION OF THE DRAWINGS

For a better understanding of the present invention, reference is made of the detailed description to be read in conjunction with the accompanying drawings, in which.

DETAILED DESCRIPTION OF THE PREFERRED EMBODIMENTS

Figure 1:
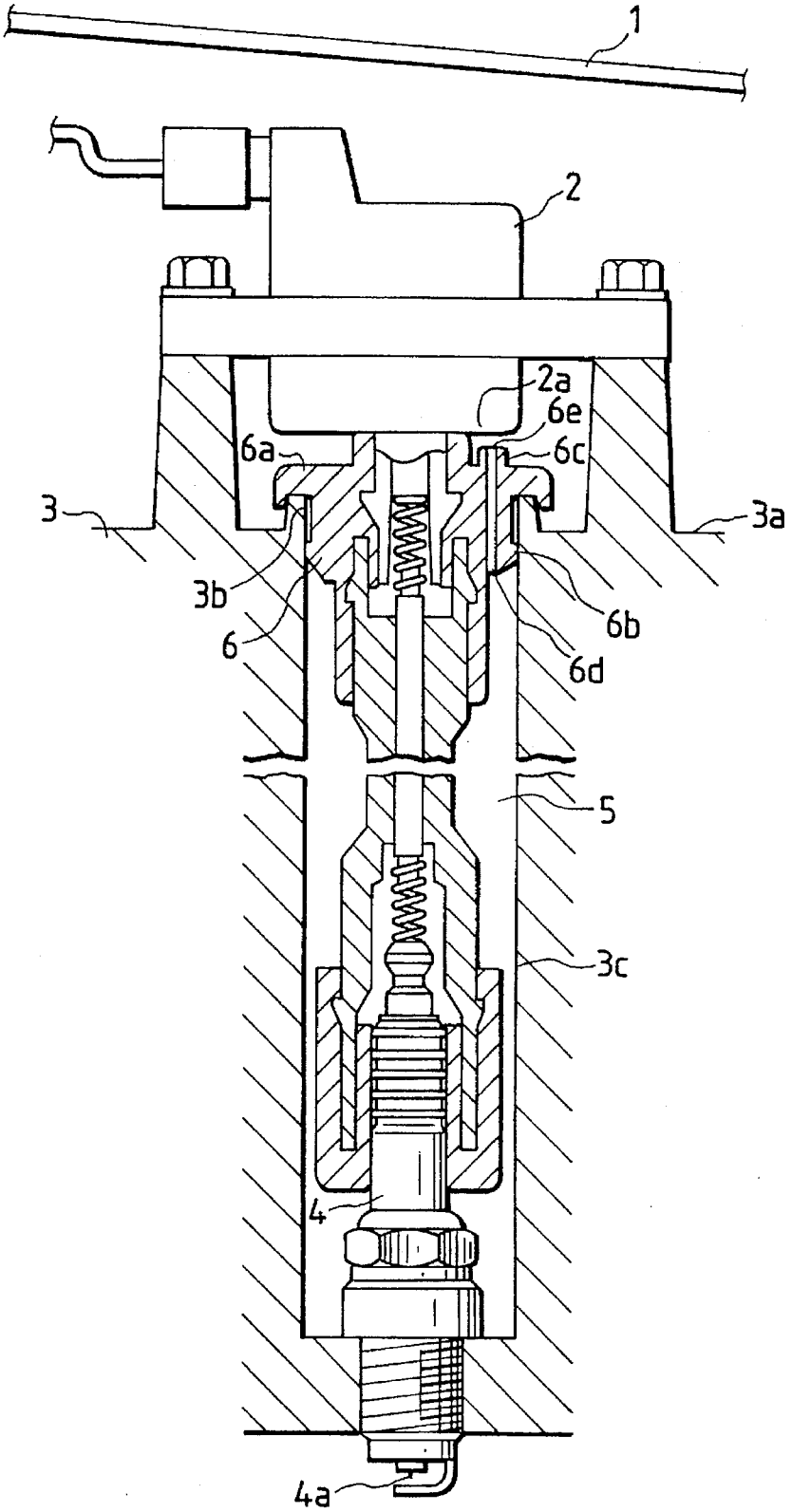
FIG. 1 PRIOR ART
FIG. 1 schematically shows a sectional view of the ignition apparatus for the conventional internal combustion engine.

Referring now to the drawings, various preferred embodiments of the present invention will be described.

EMBODIMENT 1

Figure 2:
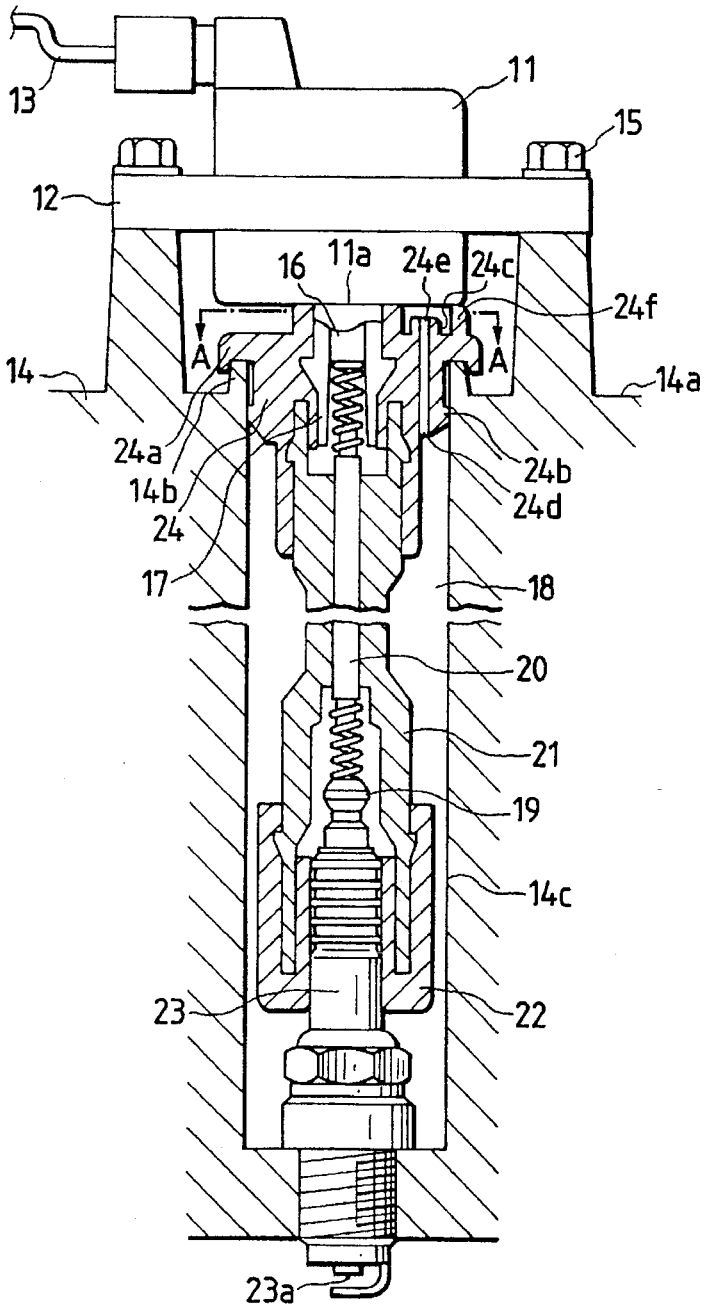
FIG. 2 schematically represents a sectional view of an ignition apparatus for an internal combustion engine according to an embodiment 1 of the present invention.
Figure 3:
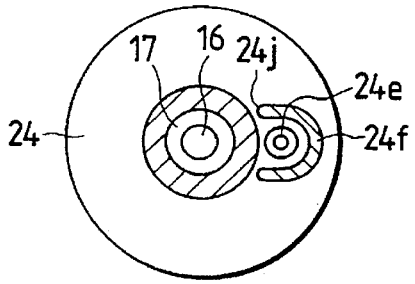
FIG. 3 is a sectional view, taken along a line A—A of FIG. 2.

FIG. 2 is a sectional view for representing an ignition apparatus used to an internal combustion engine, according to an embodiment 1 of the present invention. FIG. 3 is a sectional view for showing a plug hole cap portion employed in this ignition apparatus, taken along a line A—A of FIG. 2. In the drawing, reference numeral 11 indicates an ignition coil, reference numeral 12 shows an iron core having a hole used to mount the ignition coil, and reference numeral 13 denotes a harness connected to a unit (not shown) for driving the ignition coil 11. Furthermore, reference numeral 14 is a cylinder head cover of the internal combustion engine, which fixing thereon the ignition coil 11 through the iron core 12 by way of a bolt 15, reference numeral 14*a* shows an upper surface of the cylinder head cover 14, reference numeral 14*b* represents a ring-shaped plug hole entrance portion formed from a portion of the cylindrical head cover 14, and this plug hole entrance portion is located at a position slightly higher than the cylinder head cover's upper surface 14*a*.

Reference numeral 16 indicates a high voltage terminal through which a high voltage produced from the ignition coil 11 is derived to an external unit, reference numeral 17 denotes a high voltage tower arranged around the high voltage terminal 16, and reference numeral 18 shows a plug hole for storing the ignition plug at a bottom portion. Reference numeral 19 shows a high voltage terminal. Between this high voltage terminal 19 and the high voltage terminal 16, a conductor 20 is arranged, at least one end of which is supported by a spring. An adaptor 21 made of an insulating resin is arranged around the conductor 20.

Reference numeral 22 indicates a plug cap made of silicon rubber, connected via either an engaging portion, or an adhesive agent to an ignition plug of the adaptor 21, reference numeral 23 shows an ignition plug arranged on the cylinder of the internal combustion engine, and reference numeral 23*a* denotes a plug gap projected into a combustion room of the internal combustion engine.

Next, reference numeral 24 is a plug hole cap made of a material such as silicon rubber, which is connected to the high voltage tower 17 of the ignition coil 11 via either the engaging portion of the adaptor 21 and the adhesive agent on the side of the ignition coil 11 of the adaptor 21. Reference numeral 24*a* shows a lid-shaped portion of this plug hole cap 24, reference numeral 24*b* indicates a water resistant seal portion, reference numeral 24*c* denotes a cylinder-shaped portion projected upwardly from the lid-shaped portion 24*a*, and reference numeral 24*d* denotes an air bleeding hole penetrated from the center of the cylinder-shaped portion 24*c* through the plug hole cap 24 to the plug hole 18, and further reference numeral 24*e* shows an air bleeding hole outlet. Reference numeral 24*f* indicates a water resistance wall fabricated in such a manner that this water resistance wall 24*f* is projected to the plug hole cap 24, and surrounds at least an outer peripheral portion of the air bleeding hole outlet 24*e*. An upper surface of the water resistant wall is made in contact with the lower surface 11*a* of the ignition coil 11, and an air bleeding/water exhausting space 24*j* is formed inward.

Operations of the above-described ignition apparatus for the internal combustion engine according to the embodiment 1 of the present invention will now be explained. In general, the conductor 20, adaptor 21, plug cap 22 and plug hole cap 24 are assembled together with the ignition coil 11 by an ignition apparatus manufacturer. The assembled components are supplied from this ignition apparatus manufacturer to an automobile manufacturer and an internal combustion engine manufacturer, and are assembled with an internal combustion engine by them.

A first description will be made of ignition operation to an air-fuel mixture. In response to a primary current turned ON/OFF by a power transistor (not shown) and a control unit (not shown either) connected to the harness 13, a high voltage is generated from the ignition coil 11. This high voltage is conducted from the high voltage terminal 16 via the conductor 20 to the high voltage terminal 19 of the ignition plug 23, and then discharge spark is produced at the plug gap 23*a*, so that the air-fuel mixture present in the cylinder of the internal combustion engine is ignited.

The ignition coil 11 is positioned just above one, or two ignition plugs 23 of the internal combustion engine. Although the length of the plug hole 18 is varied with respect to the sorts of internal combustion engines, depending upon a displacement volume of an internal combustion engine and a mechanism of a cylinder head, the desired plug hole length may be achieved by varying the lengths of the adaptor 21 and the conductor 20. When the length of the plug hole 18 is not long, both of the plug cap 22 and the plug hole cap 24 can be unified in an integral form of a silicon rubber member so that the adaptor 21 is omitted.

Depending upon the required voltages of the ignition plug 23, the ignition coil 11 produces such a high voltage exceeding 30 kV which will be applied to the conductor 20 and the like. On the other hand, since the potential of the internal combustion engine such as the inner wall 14*c* of the plug hole 18 is the ground potential, each of the adaptor 21, the plug cap 22 and the plug hole cap 24 should own the sufficient voltage withstanding performance. At the same time, such a care should be taken to establish the sufficient voltage withstanding performance by assuring the distances between the surface coated by the adhesive agent and the surface located along the connection boundary between these components and the ignition coil 11. Due to the assembling conduction, no adhesive agent is coated on the surface located long the connection boundary between the plug cap 22 and the ignition plug 23. However, the voltage withstanding performance of this surface can be maintained by way of compression force of the rubber.

Under such circumstances, when water enters into the plug hole 18, water components are penetrated from the surface located along the connection boundary, by which the voltage withstanding performance can be no longer maintained. The high voltage is leaked along the plug hole inner wall 14*c*, so that since no spark is discharged at the plug gap 23, the internal combustion cannot be driven under normal condition.

Therefore, according to this embodiment 1 of the present invention, even when the ignition coil 11 is directly wetted by a large amount of water by the water resistant wall 24*f*, if the level of water reserved in the upper surface 14*a* of the cylinder head does not reach the air bleeding hole outlet 24*e*, then the water colliding with and scattered from the peripheral components is shielded by this water resistant wall 24*f* and does not directly reach this air bleeding hole outlet 24*e*, so that no water could enter into the plug hole 18.

In this case, the upper surface of the water resistant wall 24*f* is arranged in such a manner that this upper surface is made in contact with the lower surface of the ignition coil 11, so that the water resistant efficiency can be improved.

Also, the air bleeding/water exhausting space 24*j* is formed inward in the water resistant wall 24*f*, so that air and water can smoothly flow therethrough.

Figure 4:
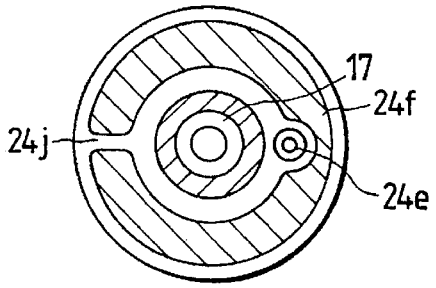
FIG. 4 is a plan/sectional view for indicating the ignition apparatus for the internal combustion engine according to the embodiment 1 of the present invention.
Figure 5:
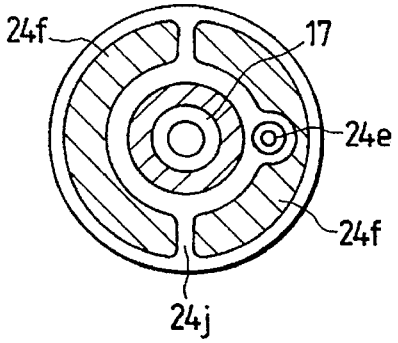
FIG. 5 is another plan/sectional view for indicating the ignition apparatus for the internal combustion engine according to the embodiment 1 of the present invention.

It should also be noted that although the water resistant wall 24*f* owns such a substantially U-shaped form as shown in FIG. 3, this shape may be substituted by a substantially ring-shaped form provided around the high voltage tower 17 of the ignition coil 11 as shown in FIG. 4. Furthermore, as illustrated in FIG. 5, this water resistant wall 24*f* may be subdivided into a plurality of wall portions as a modification of FIG. 4.

EMBODIMENT 2

Figure 6:
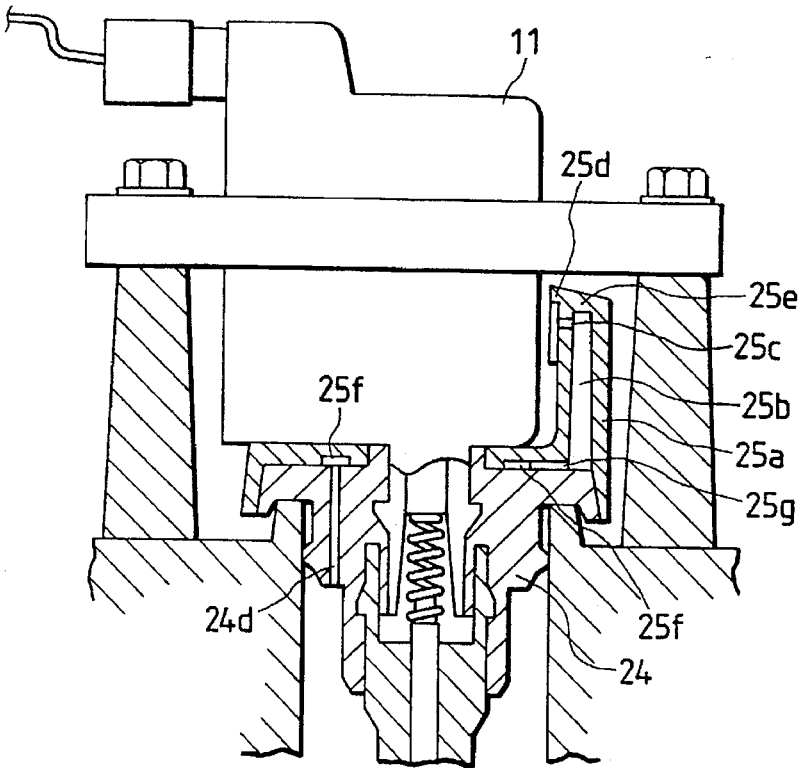
FIG. 6 is a partially sectional view for representing an ignition apparatus for an internal combustion engine according to an embodiment 2 of the present invention.
Figure 7:
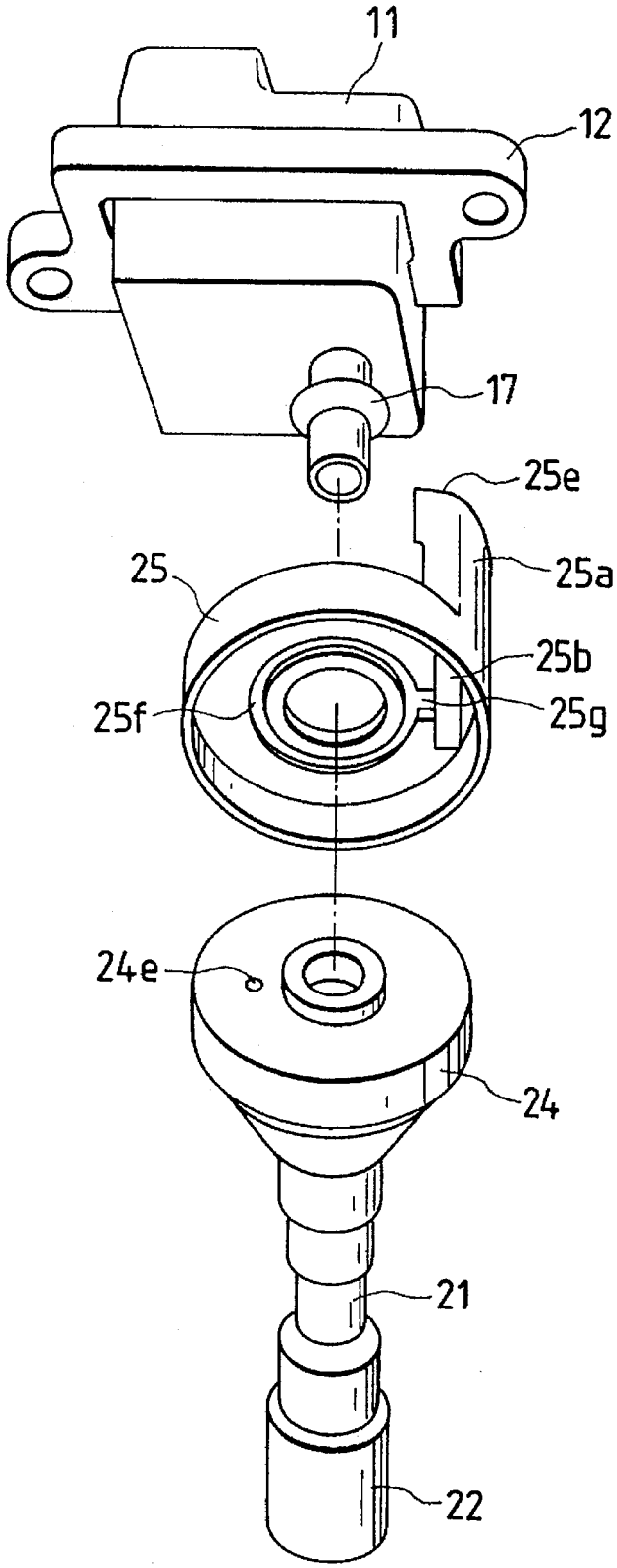
FIG. 7 is a fragmentary perspective view for showing the ignition apparatus for the internal combustion engine according to the embodiment 2 of the present invention.

Next, another embodiment 2 is shown in FIG. 6 and FIG. 7, in which a second plug hole cap 25 between the ignition coil 11 and the first plug hole cap 24. In the drawings, reference numeral 25*a* shows a tower having an air bleeding hole 25*b* inside thereof, reference numeral 25*c* denotes a narrow diameter portion of an air bleeding terminal opened toward the main body of the ignition coil 11, and reference numeral 25*d* indicates an eaves portion arranged above the narrow diameter portion 25*c* of this air bleeding terminal. Also, reference numeral 25*e* shows a tower summit portion, the outer side of which is inclined at a low angle, reference numeral 25*f* is a ring-shape air flow path, and reference numeral 25*g* shows an air flow path for connecting the air bleeding hole 25*b* to the air flow path 25*f*. In this embodiment, an air conducting/outputting path is defined by 18-24*d*-25*f*-25*g*-25*b*-25*c*-plug hole outer portion.

Both of the first plug hole cap 24 and another component are employed to increase the position of the air bleeding hole 25*c*, so that even when the ignition coil 11 is wetted by a large amount of water considerably greater than the conventional water amount, the reserved water is exhausted from the upper surface of the cylinder head before the level of reserved water reaches the position of the air bleeding hole. Accordingly, no water enters into the plug hole. Furthermore, since the air bleeding hole 25*c* is opened toward the main body of the ignition coil, the water colliding with and scattered from the peripheral components thereof does not directly reach the air bleeding hole 25*c*. Both of the eaves portion 25*d* and the tower summit portion 25*e* can avoid that such water dripped on the tower summit portion flow into the air bleeding hole.

EMBODIMENT 3

Figure 8:
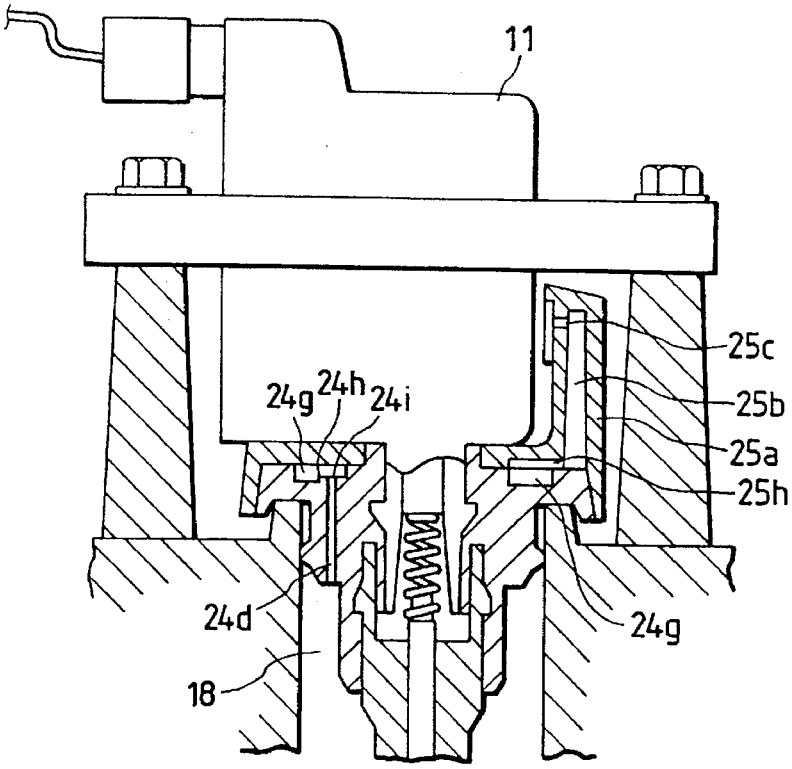
FIG. 8 is a partially sectional view for indicating an ignition apparatus for an internal combustion engine according to an embodiment 3 of the present invention.
Figure 9:
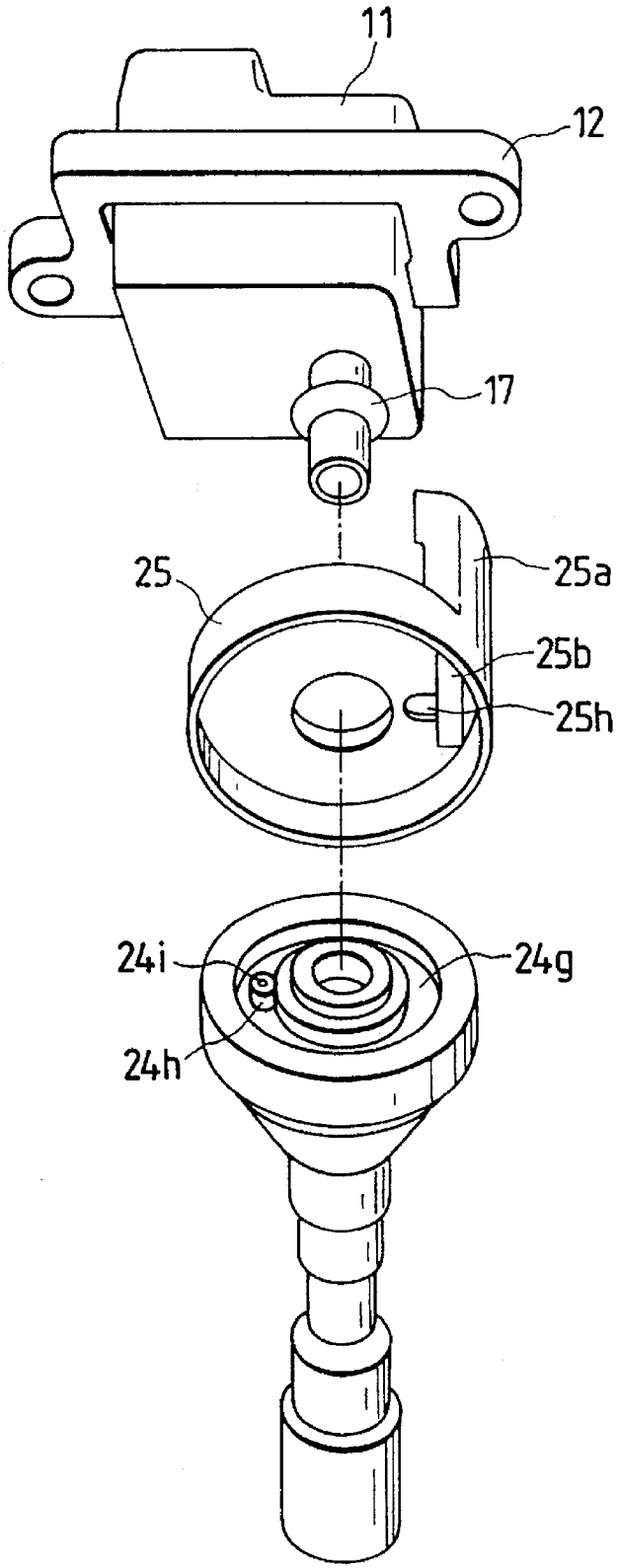
FIG. 9 is a fragmentary perspective view for showing the ignition apparatus for the internal combustion engine according to the embodiment 3 of the present invention.

A further embodiment 3 is illustrated in FIG. 8 and FIG. 9, in which a ring-shaped air flow path 24*g* is fabricated in an upper surface of the first plug hole cap 24. In this embodiment, reference numeral 25*h* indicates an air flow path for connecting this air flow path 24*g* to the air bleeding hole 25*b*, reference numeral 24*h* shows a cylinder-shaped portion projected upwardly from the bottom portion of the ring-shaped air flow path 24*g*, and reference numeral 24*i* indicates an air bleeding outlet formed in this cylinder-shaped portion. In this case, an air conducting/outputting path is defined by 18-24*d*-25*h*-25*b*-25*c*-the outer portion of the plug hole.

In this embodiment 3, since the air bleeding outlet 24*i* is formed at the summit portion of the cylinder-shaped portion 24*h* and is slightly projected from the air flow path 24*g*, even when a small amount of water is entered from the narrow diameter portion 25*c* of the air bleeding terminal into the plug hole, this water is reserved at the bottom portion of the air flow path 24*g*, but is not directly entered from the air bleeding outlet 24*i*.

Also, conversely, the entered water is evaporated from the flow path by receiving heats from the internal combustion engine.

What is claimed is:

1. An ignition apparatus of an internal combustion engine comprising:

a cylinder head cover for fixing an ignition coil;

an ignition plug stored in a plug hole formed in the cylinder head cover;

a plug hole cap for closing an upper portion of the plug hole;

an air bleeding hole penetrating said plug hole cap, for communicating the plug hole with the atmosphere; and a water resistant wall for covering at least an outside of a peripheral portion of an air bleeding hole outlet of said plug hole cap.

2. An ignition apparatus of an internal combustion engine as claimed in claim 1, wherein an upper surface of the water resistant wall is made in contact with a lower surface of the ignition coil.

3. An ignition apparatus of an internal combustion engine as claimed in claim 1, wherein an air bleeding/water exhausting space is formed in an inside of the water resistant wall.

4. An ignition apparatus of an internal combustion engine as claimed in claim 2, wherein an air bleeding/water exhausting space is formed in an inside of the water resistant wall.

5. An ignition apparatus of an internal combustion engine comprising:

a cylinder head cover for fixing an ignition coil;

an ignition plug stored in a plug hole formed in the cylinder head cover;

a plug hole cap for closing an upper portion of the plug hole;

an air bleeding hole penetrating said plug hole cap, for communicating the plug hole with the atmosphere; and an upper plug hole cap provided on said plug hole cap, said upper plug hole cap including a tower having an air bleeding hole communicated with the air bleeding hole formed in said plug hole cap.

6. An ignition apparatus of an internal combustion engine as claimed in claim 5, wherein a ring-shaped air flow path is formed in an upper surface of said plug hole cap;

a cylinder-shaped portion is formed in said upper surface of said plug hole cap in such a manner that said cylinder-shaped portion is projected from a bottom portion of said ring-shaped air flow path; and an air bleeding hole outlet is formed in an upper surface of said cylinder-shaped portion.

7. An ignition apparatus of an internal combustion engine as claimed in claim 5, wherein a terminal portion of the air bleeding hole formed in the tower is directed to the ignition coil.

8. An ignition apparatus of an internal combustion engine as claimed in claim 6, wherein a terminal portion of the air bleeding hole formed in the tower is directed to the ignition coil.

* * * * *